US005276948A

United States Patent [19]

Steadman

[11] Patent Number: 5,276,948

[45] Date of Patent: Jan. 11, 1994

[54] BUTTONING DEVICE

[76] Inventor: Robert Steadman, 10333 Parmesan Rd., Lucerne Valley, Calif. 92356

[21] Appl. No.: 961,145

[22] Filed: Oct. 14, 1992

[51] Int. Cl.[5] ..... A44B 1/00; B25F 1/00

[52] U.S. Cl. ..... 24/40; 7/123

[58] Field of Search ..... 24/40, 41; 7/123, 169

[56] References Cited

U.S. PATENT DOCUMENTS

| | | | |
|---|---|---|---|
| 178,778 | 6/1876 | Hurlbut | 24/40 |
| 235,974 | 12/1880 | Wilkins | 24/40 |
| 240,632 | 4/1881 | Adamson | 24/40 |
| 1,291,563 | 1/1919 | Laughlin | 24/40 |
| 1,306,790 | 6/1919 | Vogel | 7/123 |
| 2,461,639 | 2/1949 | Grigalunas | 7/169 |
| 4,942,646 | 7/1990 | Sabastian | 24/40 |

FOREIGN PATENT DOCUMENTS

| | | | |
|---|---|---|---|
| 0014902 | 12/1880 | Fed. Rep. of Germany | 24/40 |
| 0598592 | 12/1925 | France | 24/40 |
| 0252300 | 3/1927 | Italy | 24/40 |

*Primary Examiner*—Victor N. Sakran

*Attorney, Agent, or Firm*—Lawrence S. Cohen; Arthur Freilich

[57] ABSTRACT

A button assisting tool having a bifurcated pronged section set at an angle to an intermediate section and joined thereto by a joinder section which establishes the angle; and a shank attached to the opposite end of the intermediate section and set at an angle opposite in direction of the angle of the bifurcated section.

5 Claims, 3 Drawing Sheets

BUTTONING DEVICE

FIELD OF THE INVENTION

This invention relates to tools for assisting in placing a button in a button hole.

BACKGROUND

U.S. Pat. No. 1,291,563 shows a shoe and glove buttoner having a pair of flared prongs for engaging a button, and a straight shank, there being a curve where the prongs join the shank to dispose the ends of the prongs at an angle to the shank.

U.S. Pat. No. 687,135 shows a collar buttoning device which has a spoon shaped end having a notch and wedge portion adjacent the spoon shaped end, and also having a shank. This device is used by inserting it through the button hole from the inside so that the flat shank easily enters the button hole and then the wedge portion spreads the button hole.

U.S. Pat. No. 1,306,790 shows a shoe buttoner having a shoe horn at one end, so that that transverse curve of the shoe horn provides stiffness. The shank is bent longitudinally near the lower portion to provide a curve portion.

U.S. Pat. No. 339,055 shows a boot buttoner with a bifurcated end which is bent slightly toward the shank.

German Patent 14,902 shows a boot buttoner in which a bifurcated end is disposed at an angle to a shank.

U.S. Pat. No. 178,778 shows a button hook with a bifurcated end which is bent away from the shank.

SUMMARY OF THE INVENTION

The invention is a button fastener tool in which a button engaging portion has spaced apart prongs to engage a button defining a button engaging portion. The button engaging portion joins a button hole engaging portion, by a curved or bent joinder portion so that the prongs are set at about 90° to the button hole engaging portion. The button hole engaging portion extends some distance to a second bend or curve in a direction away from the bend or curve of the joinder portion to provide an elongated shank. The tool is formed of a thin material having a constant thickness. The transverse dimension varies. The joinder portion is transversely thinner than the pronged button engaging portion at its one end and the button hole engaging portion at its other end to provide a transversely necked down portion.

DETAILED DESCRIPTION

Figure 1:
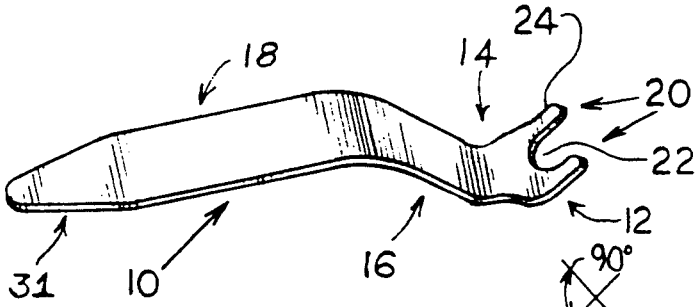
FIG. 1 is a perspective of a preferred embodiment of the tool of the invention.
Figure 2:
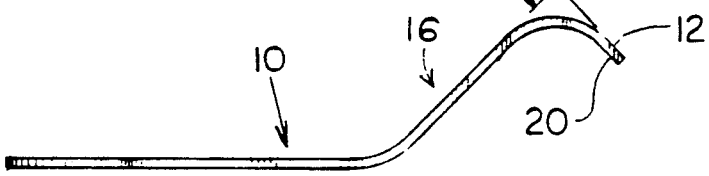
FIG. 2 a top view of the tool of FIG. 1.
Figure 3:
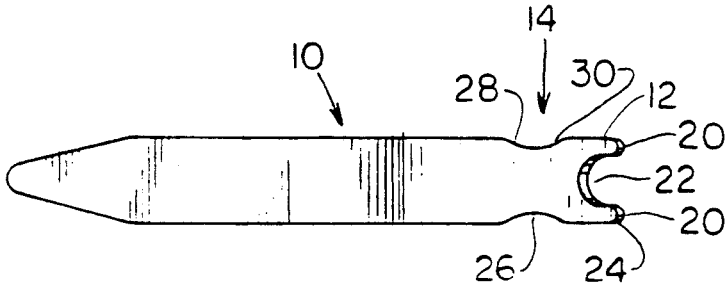
FIG. 3 is a front view of the tool of FIG. 1.
Figure 4:
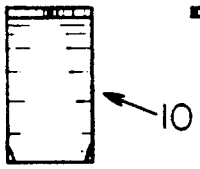
FIG. 4 is a left side view of the tool of FIG. 1.
Figure 5:
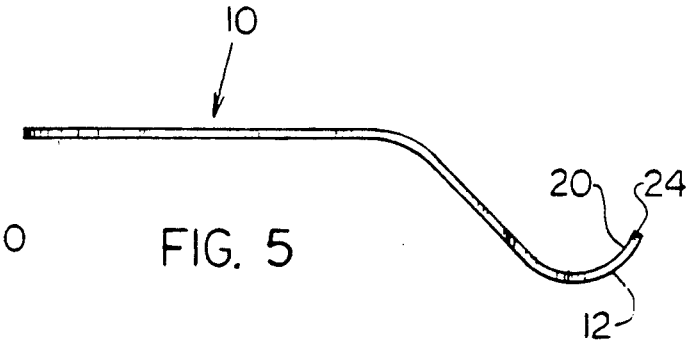
FIG. 5 is a bottom view of the tool of FIG. 1.
Figure 6:
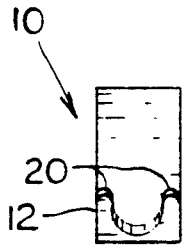
FIG. 6 is a right side view of the tool of FIG. 1.
Figure 7:
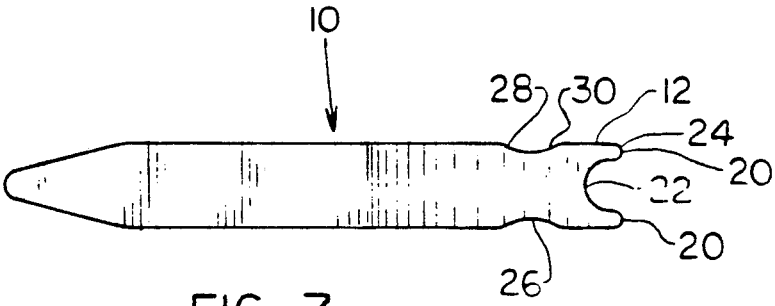
FIG. 7 is a back view of the tool of FIG. 1.

The button fastening tool of this patent has the features of providing for bringing a button and button hole into alignment which is resisted by a relatively strong separating force and also accomplishing such alignment when the button and button hole are initially separately by relatively great distance.

In one particular it provides a final thrust of closure of the separation to bring the button and the button hole into alignment. In another particular, it is able to reach a great distance between the button and button hole allowing sufficient leverage to bring them together; and further increasing the leverage when the resistance to aligning them is greatest.

The present tool can be used to button parts such as jeans in the mode of fashion where a tight fit around the waist is desired; or where a wide separation is otherwise presented such as by an elastic or expandable waistband.

Also, the present tool can be used in other applications where great force is required and tolerable such as for buttoning tent portions or tarpaulins.

Referring to FIGS. 1–7 the button fastening tool 10 has a bifurcated button engaging end 12, a joinder section 14, and intermediate section 16 and a shank 18.

The bifurcated button engaging end 12 has a pair of prongs 20 which are spaced apart to create a notch 22 for receiving a button shank or threads. The prongs 20 end at terminal ends 24. The prongs 20 are preferably curved as shown but could be straight at their open terminal ends.

The joinder section 14 is curved or bent and commences approximately at the bottom of the notch 22 formed by the prongs 20. The joinder section 14 ends at the intermediate section 16. The curve of the joinder section 14 alone or coupled with the additional curve of the bifurcated bottom engaging end 12 present the terminal ends 24 of the prongs at approximately 90° to the intermediate section 16. Also, the joinder section 14 is necked-down as at 26 so that there is a neck entry taper 28 and a neck exit taper 30. The neck entry taper 28 could extend slightly into the intermediate section 15 and similarly the neck exit taper 20 could extend slightly into the bifurcated end 12.

The intermediate section 16 is straight and joins the shank 18 at an angel opposite in direction to that between the intermediate section 16 and the bifurcated end 12. The angle is about 45°.

Figure 8A:
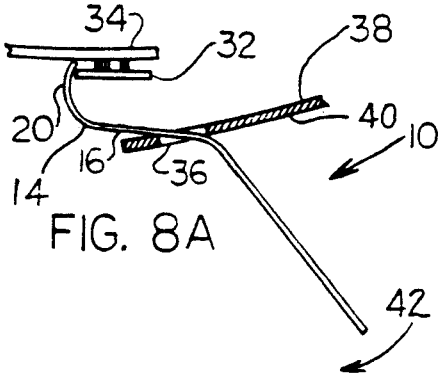
FIG. 8A is a top view of the tool being used in a closely spaced button and button hole combination.

FIG. 8A shows the tool 10 in position ready for use in joining a button and button hole which are not widely separated.

The button 32 is attached to a fabric section 34 and the button hole 36 is formed in a fabric section 38. In this case the tool 10 is easily inserted from the front side 40 of the fabric section 38, and the prongs 20 catch on the button 32. The intermediate section 16 is in the button hole 36. To operate the tool 10 it is rotated in the direction of the arrow 42 using the button 32 as a fulcrum against the prongs 20. Because of the configuration of the elements as above described, in case of great resistance of the fabric sections 34 and 38 to being drawn together, great leverage is available at the shank 18, but the button hole will slide easily along the intermediate section 16 to the joinder section 14.

Figure 8B:
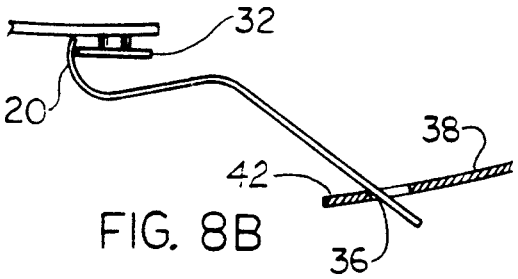
FIG. 8B is a top view of the tool used in a widely spaced button and button hole combination.

FIG. 8B shows an application of the tool 10 where the button 32 and the button hole 36 are widely separated. In this case, the shank has been inserted from the inside of button hole fabric 38 and the prongs 20 hooked onto the button 32.

Less leverage is initially available in this set up as compared to that of FIG. 8A, but still enough to pull the button hole 30 to toward the button 32, sliding along the shank 18, until the intermediate section 16 enters the button hole 36. At this point, more resistance would be expected, and as described in reference to FIG. 8A, more leverage is available.

Figure 9:
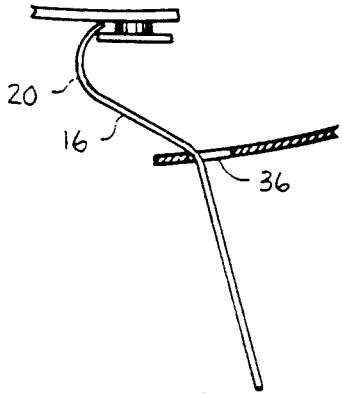
FIG. 9 is a top view of the tool at an intermediate point in its operation.

FIG. 9 shows the position where having reduced the distance between the button hole 36 and the button 32 the tool 20 is part way through the rotation, now having readied the greatest leverage due to the shape of the tool 20. This leverage continues at a high level as long as the button hole 36 is on the intermediate section 16.

Figure 10:
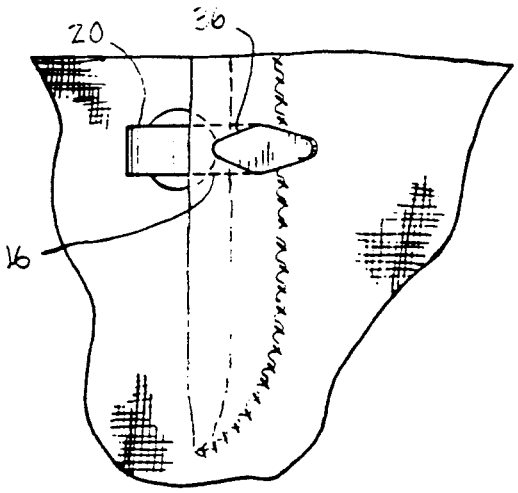
FIG. 10 is a view of the tool of FIG. 1 at an intermediate point in its operation seen from the front showing a pant fly buttoned.

FIG. 10 shows a front view of the position of FIG. 9.

Figure 11:
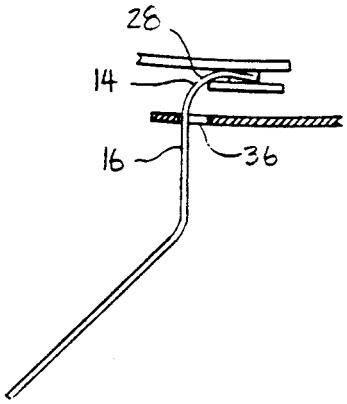
FIG. 11 is a view of the tool of FIG. 1 in use at a point in which the button and button hole are aligned.

FIG. 11 shows the position where the button hole is about to leave the intermediate portion 16 and ride along the neck entry taper 28 of the joinder section 14. The neck entry taper 28 makes this part of the operation less likely to damage the button hole 36 which at this point is at right angle to the tool; that is at the maximum force position.

Figure 12:
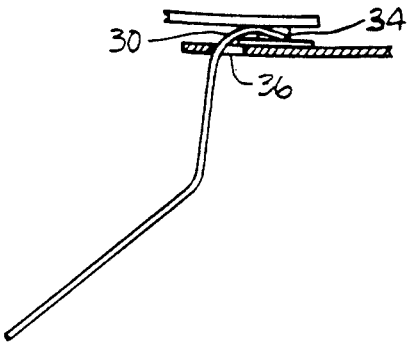
FIG. 12 is a view of the tool of FIG. 1 in use at a point in which the button and button hole are both aligned and pulled into contact.

FIG. 12 shows the button hole 36 ready to be spread slightly by the neck exit taper 30; the button 34 now being aligned with and in contact with the button hole 36.

In order to cause the button 34 to pass through the button hole some manipulation such as up or down wiggling combined with some arcuate rotation of the tool may be necessary.

Figure 13:
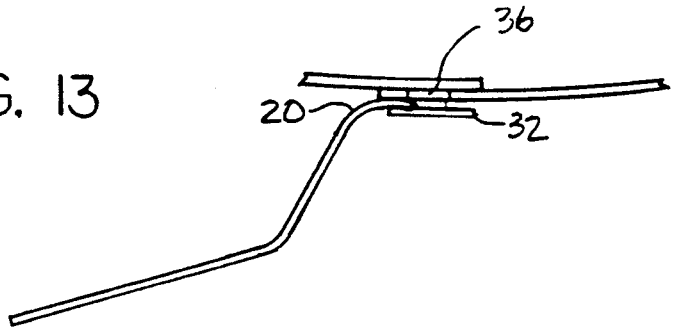
FIG. 13 is a view of the tool of FIG. 1 in use at a point in which the button has been drawn through the button hole.
Figure 14:
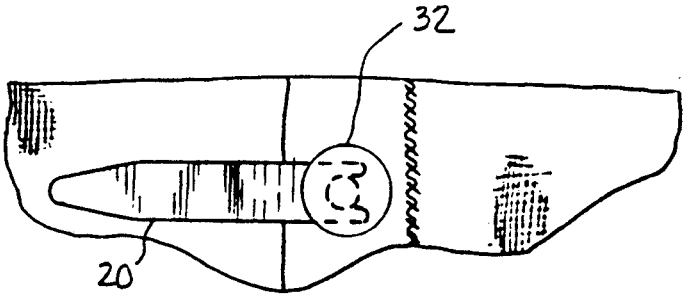
FIG. 14 is a front view of the arrangement of FIG. 13.

FIGS. 13 and 14 show the buttoning operation completed.

Figure 15:
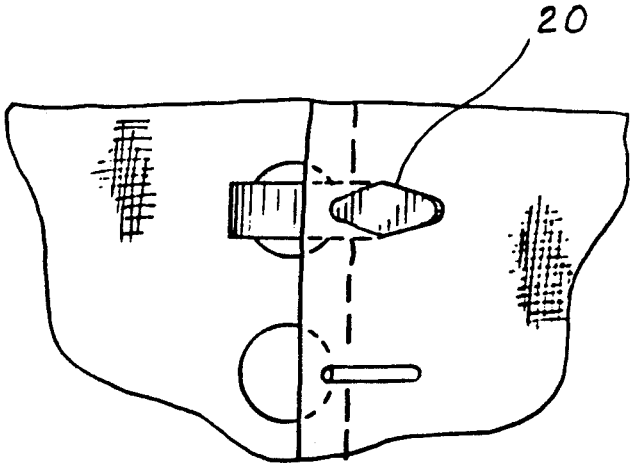
FIG. 15 is a front view of the invention in use in an application such as a tent, tarpaulin or poncho.

FIG. 15 shows the tool 20 being used in an application such as a tent, tarpaulin or poncho where a row of buttons require buttoning.

Although particular embodiments of the invention have been described and illustrated herein, it is recognized that modifications and variations may readily occur to those skilled in the art, and consequently it is intended that the claims be interpreted to cover such modifications and equivalents.

I claim:

1. A tool for aligning a button to a button hole comprising;

a bifurcated section having a pair of spaced prongs defining a notch and having a terminal end and a base end;

an intermediate section extending at an angle to the bifurcated section;

a joinder section joining the bifurcated section and the intermediate section and providing the angular relationship between the bifurcated section and the intermediate section;

a shank attached to a far end of the intermediate section and extending therefrom at an angle opposite to the angle of the bifurcated section.

2. The tool of claim 1 wherein the angle between the bifurcated section and the intermediate section and the shank is about 90°.

3. The tool of claim 2 wherein the angle between the intermediate section and the shank is about 45°.

4. The tool of claim 1 further wherein the tool has a constant transverse dimension except that the joinder section has a width which is necked down by opposed tapers from the bifurcated section and the intermediate section respectively.

5. The tool of claim 4 wherein the shank has a terminal end the transverse dimension of which tapers.

* * * * *